US006393709B1

(12) United States Patent
Jones

(10) Patent No.: US 6,393,709 B1
(45) Date of Patent: May 28, 2002

(54) CHALK COLLECTOR AND METHOD

(76) Inventor: Gary W. Jones, 218 N. Maple St., Graham, NC (US) 27253

( * ) Notice: Subject to any disclaimer, the term of this patent is extended or adjusted under 35 U.S.C. 154(b) by 0 days.

(21) Appl. No.: 09/536,441

(22) Filed: Mar. 28, 2000

(51) Int. Cl.[7] ..... B44D 3/38
(52) U.S. Cl. ..... 33/414
(58) Field of Search ..... 33/413, 414

(56) References Cited

U.S. PATENT DOCUMENTS 4,197,656 A * 4/1980 Lane et al. ..... 33/414
4,459,761 A * 7/1984 Bosco ..... 33/414
5,465,494 A * 11/1995 Johnston ..... 33/414
5,586,394 A * 12/1996 Courtney ..... 33/394
5,727,324 A * 3/1998 Moore ..... 33/414
6,079,112 A * 6/2000 Love ..... 33/414

* cited by examiner

*Primary Examiner*—Diego Guiterrez
*Assistant Examiner*—R. Alexander Smith

(57) ABSTRACT

A chalk collector is provided which can be easily affixed to a conventional wheel type chalk line assembly. The collector includes a fine passageway which gathers excess chalk as the chalk line is withdrawn from the housing. Apertures or conduits are provided for returning the chalk to the chalk line assembly housing for reuse.

8 Claims, 2 Drawing Sheets

CHALK COLLECTOR AND METHOD

FIELD OF THE INVENTION

The invention herein pertains to chalk line devices as are used in construction and other industries and in particular pertains to a chalk collector for use therewith.

DESCRIPTION OF THE PRIOR ART AND OBJECTIVES OF THE INVENTION

Chalk line devices and assemblies have been commercially available for many years which include a housing containing a spool of line and powdered chalk. As the chalk line is withdrawn from the housing for marking purposes such as forming chalk lines on a roof while laying shingles, the line passes through contained powdered chalk which adheres to the outer surface of the line. After a mark is made with the withdrawn chalk line, the chalk line can be reeled back into the housing where it again passes through a reservoir of chalk and is ready for use again. Such reel containing chalk line assemblies are effective but waste great percentages of chalk since cotton or other absorbent type lines pick up excess chalk which is dispersed into the atmosphere as the chalk line is withdrawn from the housing. Even newer chalk line assemblies having internal chalk line "blades" or fiber masses do not remove all the excess line chalk. Thus, about fifty percent of the powdered chalk contained within the housing is dispersed or wasted immediately as the chalk line is withdrawn. Only about one-half of the chalk actually remains on the line for use in marking purposes. In addition to the excess waste, chalk dust can cause health problems to individuals and other animals that are subjected thereto. Dangerous allergic reactions can occur to workers that continually use chalk lines daily. Also, the constant use of a chalk line assembly can be expensive as the powdered chalk supply must be replenished frequently.

Thus, with the problems and disadvantages associated with prior art chalk line devices, the present invention was conceived and one of its objectives is to provide an attachment for a conventional chalk line assembly which eliminates and remedies the problem of excess chalk which is carried on a chalk line It is a further objective of the present invention to provide a chalk collector and a method of use which allows excess chalk to be saved and returned to the chalk line assembly It is still another objective of the present invention to provide a method for collecting excess chalk from a chalk a line utilizing an attached collector.

It is a further objective of the present invention to provide a chalk line collector which will easily, readily return the excess chalk to the assembly housing for reuse.

Various other objectives and advantages of the present invention will become apparent to those skilled in the art as a more detailed description is set forth below.

SUMMARY OF THE INVENTION

The aforesaid and other objectives are realized by providing a method and chalk collector which can be attached to the top of a conventional reel-type chalk line assembly. The chalk collector includes a passageway through which the chalk line passes with sufficient volume to receive a substantial quantity of excess powdered chalk which is dispelled from the chalk line as it passes therethrough.

DETAILED DESCRIPTION OF THE PREFERRED EMBODIMENT AND OPERATION OF THE INVENTION

Figure 1:
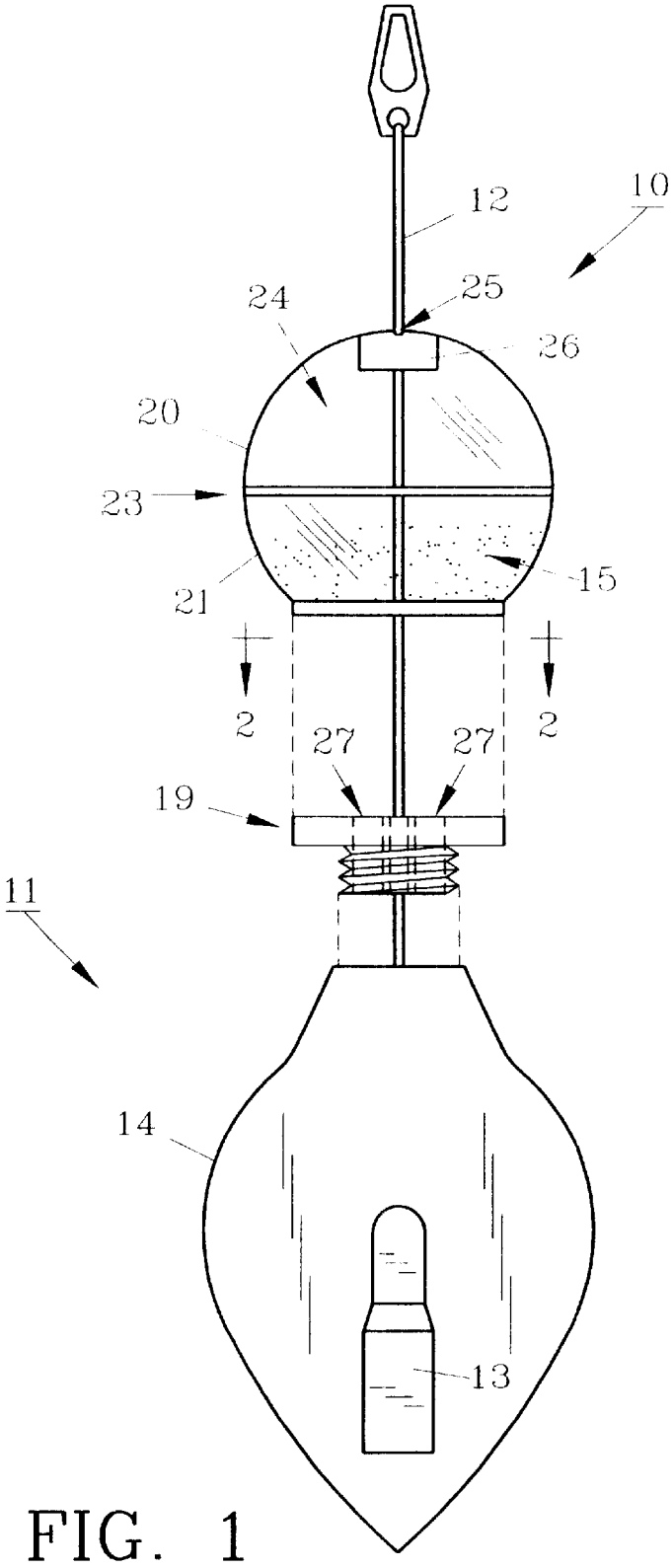
FIG. 1 demonstrates an elevational view of a chalk line collector and chalk line collector exploded from a reel-type chalk line assembly.

For a more detailed description of the invention and its operation, turning now to the drawings, FIG. 1 illustrates preferred chalk collector 10 having a somewhat spherical shape for attachment to conventional reel type chalk line assembly 11. Chalk line assembly 11 includes an internal reel (not shown) which may contain fifty feet of chalk line 12 therein. Handle 13 is affixed to the reel internal of housing 14 which also contains a supply of powdered chalk 15. As would be understood, housing cap 19 is threadably tightenable onto housing 14 and chalk collector 10 is threadably tightened onto cap 19. Collector 10 is preferably molded and provides top half 20 and bottom half 21 which are threadably joined along lines 23. Spherical collector 10 is formed from a transparent polymeric material such as a polycarbonate or other polymeric material and includes an internal passageway 24 through which chalk line 12 is directed. Passageway 24 extends to the top of spherical collector 10 and communicates with line outlet 25 which is surrounded internally by fiber mass 26 which acts to remove excess chalk contained on line 12.

Figure 2:
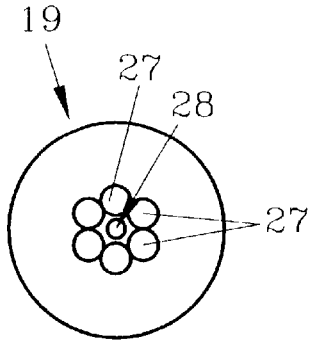
FIG. 2 shows a top view of the chalk line assembly cap along lines 2—2 of FIG. 1.
Figure 4:
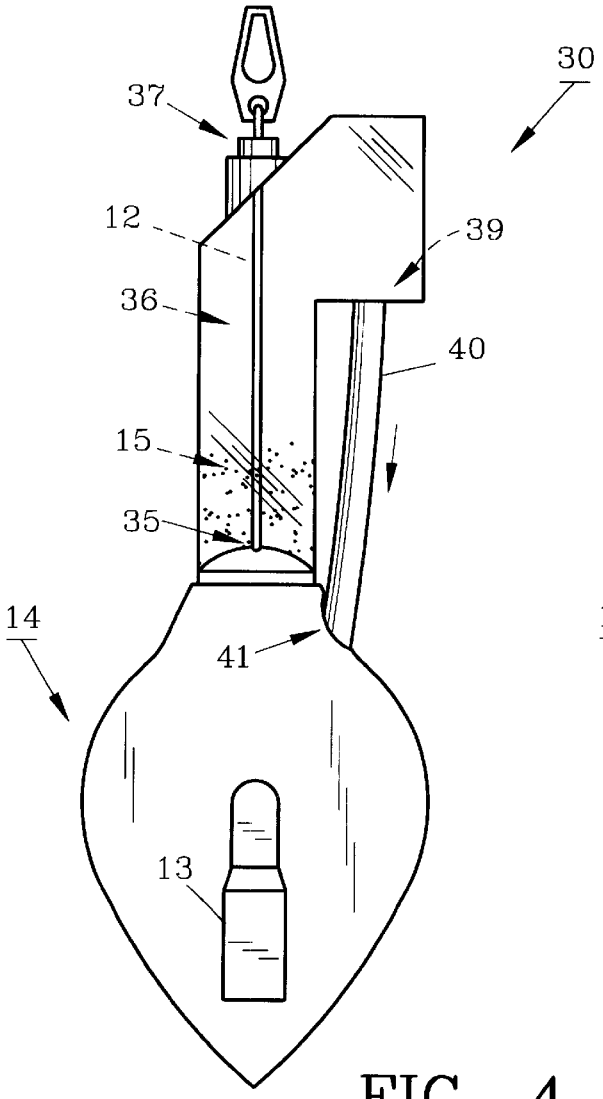
FIG. 4 features the chalk collector of FIG. 3 attached to the reel-type chalk line assembly.
Figure 3:
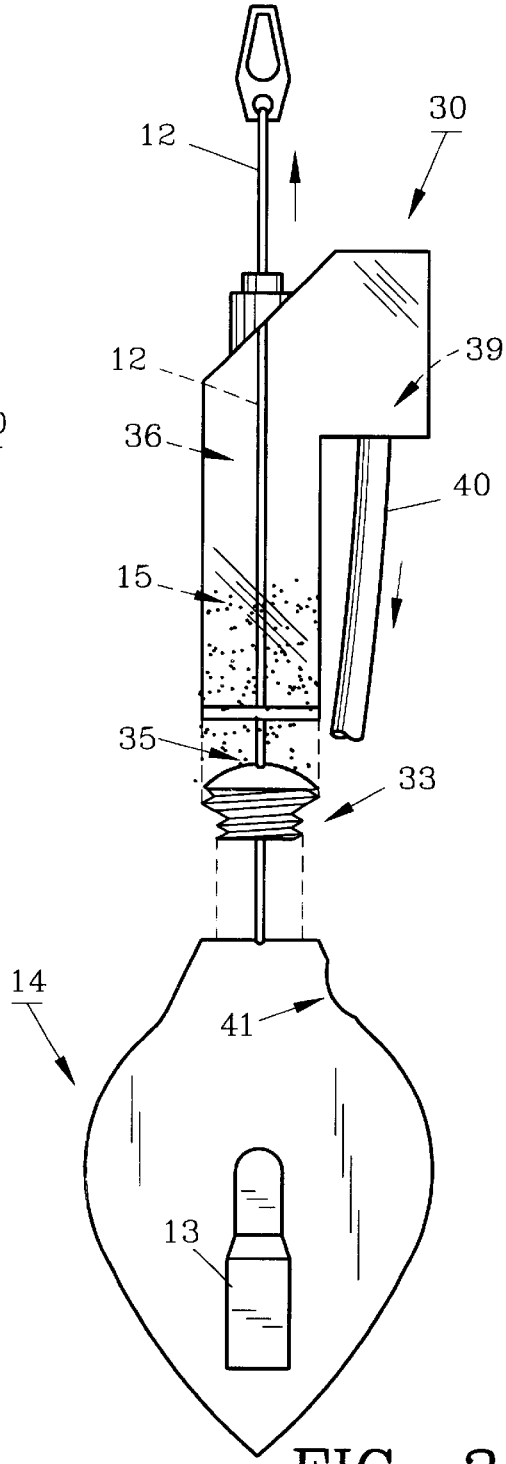
FIG. 3 depicts a side view of a reel-type chalk line assembly with an alternate chalk collector exploded therefrom.

In the preferred method of use, chalk line 12 is pulled from housing 14 and excess chalk falls into chalk collector 10 and any additional excess chalk is removed by fiber mass 26 which may be a nonwoven cotton or synthetic fiber. As also seen in FIG. 2, cap 19 includes a series of relatively large conduits 27 and a relatively small aperture 28 through which line 12 passes. Once a sufficient amount of excess chalk 15 is present in chalk collector 10, collector 10 can be shaken or tapped whereby excess chalk will pass from collector 10 through conduits 27 and return to housing 14 where it is again available for use. In an alternate embodiment of the invention as shown in FIGS. 3 and 4, chalk collector 30 is seen affixed to conventional reel-type chalk line assembly 14. As shown in FIG. 3, cap 33 is threadably attached to housing 14. Chalk collector 30 is threadably tightened onto the wider dimensioned threads of cap 33 as shown in FIG. 4. Line 12 exits outlet 35 and enters passageway 36 of chalk collector 30. Outlet 37 shown in FIG. 4 provides an outlet for line 12 as it passes through chalk collector 30. As chalk 15 accumulates in collector 30, collector 30 can be tilted in a clockwise position as shown in FIGS. 3 and 4 to allow chalk 15 to enter side reservoir 39. Chalk 15 will then descend by gravity through return conduit 40 and return to housing 14 through housing opening 41 where it can be again used. By the use of chalk collectors 10 or 30, approximately one-half of the chalk used can be collected and returned for reuse.

The illustrations and examples provided herein are for explanatory purposes and are not intended to limit the scope of the appended claims.

I claim:

1. In a chalk line assembly having a housing containing a chalk line and a quantity of chalk whereby said chalk line is coated with chalk as it is withdrawn from said housing, the improvement comprising: a chalk collector, said chalk collector positioned proximate said housing, said chalk collector defining a chalk line passageway for collecting chalk from said chalk line as it passes therethrough, a separate return conduit, said return conduit communicating with said chalk collector and said housing to allow collected chalk to pass to said housing.

2. The chalk line assembly of claim 1 wherein said chalk collector defines a chalk line inlet and a chalk line outlet, said inlet and said outlet each in fluid communication with said chalk line passageway.

3. The chalk line assembly of claim 1 wherein said chalk collector is attached to said assembly housing.

4. The chalk line assembly of claim 1 wherein said chalk collector is formed from a polymeric material.

5. The chalk line assembly of claim 4 wherein said chalk collector further comprises a chalk remover, said chalk remover positioned proximate said chalk line outlet to frictionally engage said chalk line.

6. A method of collecting excess chalk from a chalk line comprising the steps of:

(a) directing a chalk line through a chalk collector attached proximate a chalk line assembly; and (b) rubbing the chalk line against the chalk collector prior to exiting said chalk collector to dislodge chalk thereon;

(c) collecting the dislodged chalk within said collector; and (d) returning the collected chalk to said chalk line assembly through a separate conduit.

7. The method of claim 6 wherein rubbing the chalk line against the collector comprises the step of rubbing the chalk line against the collector in a continuous manner.

8. The method of claim 6 wherein returning the collected chalk comprises the step of returning said collected chalk through a return conduit affixed to said chalk line assembly.

* * * * *